US007753019B2

(12) United States Patent
Litorell et al.

(10) Patent No.: US 7,753,019 B2
(45) Date of Patent: Jul. 13, 2010

(54) PHASE ADJUSTING DEVICE

(75) Inventors: Martin Litorell, Göteborg (SE); Sören Eriksson, Kungalv (SE); Jan Erik Andersson, Onsala (SE)

(73) Assignee: Ford Global Technologies, LLC, Dearborn, MI (US)

( * ) Notice: Subject to any disclaimer, the term of this patent is extended or adjusted under 35 U.S.C. 154(b) by 358 days.

(21) Appl. No.: 12/052,041

(22) Filed: Mar. 20, 2008

(65) Prior Publication Data

US 2008/0230026 A1 Sep. 25, 2008

(30) Foreign Application Priority Data

Mar. 23, 2007 (EP) ..... 07104734

(51) Int. Cl.
*F01L 1/34* (2006.01)

(52) U.S. Cl. ..... 123/90.18; 123/90.17

(58) Field of Classification Search ..... 123/90.17, 123/90.18

See application file for complete search history.

(56) References Cited

U.S. PATENT DOCUMENTS

| | | | | |
|---|---|---|---|---|
| 4,976,229 | A | 12/1990 | Charles | |
| 4,986,801 | A | 1/1991 | Ohlendorf | |
| 5,426,992 | A | 6/1995 | Morii | |
| 5,592,909 | A * | 1/1997 | Tsuruta | 123/90.17 |
| 6,167,854 | B1 * | 1/2001 | Regueiro | 123/90.17 |
| 6,832,586 | B2 * | 12/2004 | Williams | 123/90.17 |
| 7,237,516 | B2 * | 7/2007 | Kunz | 123/90.17 |
| 7,246,579 | B2 * | 7/2007 | Kimura et al. | 123/90.16 |
| 2003/0106513 | A1 * | 6/2003 | Kunz et al. | 123/90.18 |

FOREIGN PATENT DOCUMENTS

| | | |
|---|---|---|
| EP | 723094 B1 | 1/1996 |
| WO | WO 2006/025173 A1 | 3/2006 |

OTHER PUBLICATIONS

Anonymous: "Torsional actuator" Research Disclosure, Mason Publications, Hampshire, GB, vol. 304, No. 38, Aug. 1989, XP007114041, ISSN: 0374-4353.

* cited by examiner

*Primary Examiner*—Thomas E Denion
*Assistant Examiner*—Daniel A Bernstein
(74) *Attorney, Agent, or Firm*—Julia Voutyras

(57) ABSTRACT

The invention relates to a transmission assembly (34), for imparting a phase difference between an outer wheel and an inner wheel of a spline VVT. The assembly comprises a tubular meshing member (36) having an inner surface (38) and an outer surface (40), wherein at least a portion of the inner surface is provided with a first spline (42) and at least a portion of the outer surface is provided with a second spline (44). The first spline and the second spline do not have the same pitch in the same groove direction. The transmission assembly further comprises a bearing arrangement (46) and an actuation member (48). The bearing arrangement is arranged between the meshing member and the actuation member to allow a transfer of an axial displacement of the actuation member to the meshing member and allow a rotation of the meshing member relative to the actuation member.

14 Claims, 8 Drawing Sheets

PHASE ADJUSTING DEVICE

TECHNICAL FIELD

The present invention relates to a transmission assembly, for imparting a phase difference between an outer wheel and an inner wheel of a spline VVT. The assembly includes a tubular meshing member having an inner surface and an outer surface. At least a portion of the inner surface is provided with a first spline and at least a portion of the outer surface is provided with a second spline. The first spline and the second spline do not have the same pitch in the same direction.

BACKGROUND OF THE INVENTION

Modern internal combustion engines used in vehicles are generally provided with at least one camshaft. The camshaft cooperates with cam lobes of intake and exhaust valves of cylinders of the engine such that a rotation of the camshaft opens and closes the valves. The camshaft is generally driven by the crankshaft of the engine, wherein a rotation of the crankshaft is transmitted to the camshaft by cam belt or cam chain engaged with a sprocket connected to the camshaft.

To achieve at least one of the benefits of: a lower fuel consumption; increased power, or lower emissions of the engine, a rotational phase difference between the crankshaft and the camshaft is regulated as a function of a plurality of parameters, e.g. the temperature of the engine. To regulate the phasing, the prior art teaches, inter alia, the use of a spline VVT (Variable Valve Timing). Typically, a spline VVT has an outer wheel attached to the sprocket, an inner wheel attached to the camshaft and a center wheel located in-between, meshing with both of the outer and inner wheels. Generally, the outer wheel is inwardly provided with a helical spline and the inner wheel is outwardly provided with a helical spline with an opposite groove direction. The center wheel is provided with inward and outward splines, corresponding to the splines of the inner and outer wheels.

When a change in the rotational phase between the crankshaft and the camshaft is requested, the center wheel is displaced axially, resulting in a rotation of the inner wheel with respect to the outer wheel due to the interaction of the splines of the outer, center and inner wheels. Hence, the camshaft is rotated with respect to the sprocket resulting in a phase lag or lead with respect to the crankshaft.

Prior art teaches various ways of imparting the axial displacement on the center wheel. For example, previously known solutions utilize hydraulic arrangements for applying a hydraulic pressure on either side of a piston fixed to the center wheel to impart an axial motion. However, this generally results in a complex hydraulic system several components of which are rotating with the spline VVT when the engine is running.

Prior art, e.g. WO 2006/025173, also teaches that a permanent-magnet rotary drum may be attached onto the center wheel. The center wheel may be displaced by braking or accelerating the drum by an electromagnetic clutch fixedly connected to the engine. However, the aforementioned solution requires that the rotary drum is imparted the same rotational velocity as the center wheel to maintain a selected phase difference between the rotation of the camshaft and the rotation of the crankshaft. This may require a power supply to the spline VVT system whenever the engine is running.

SUMMARY OF THE INVENTION

The invention relates to a transmission assembly, for imparting a phase difference between an outer wheel and an inner wheel of a spline VVT. The assembly includes a tubular meshing member having an inner surface and an outer surface in which at least a portion of the inner surface is provided with a first spline and at least a portion of the outer surface is provided with a second spline. The first spline and the second spline do not have the same pitch in the same direction. The feature shown in one embodiment that the first and second splines do not have the same pitch in the same direction stipulates that the first and second splines differ in pitch and/or groove direction. As such, the first and second splines may have the same pitch but opposite groove directions. Optionally, the first and second splines have the same groove direction but different pitches. In one example, one of the splines is straight whereas the other is a helical spline. Alternatively, the first and second splines may have different pitches as well as different groove directions.

According to the present invention the transmission assembly has a bearing arrangement and an actuation member. The bearing arrangement is arranged between the meshing member and the actuation member to allow a transfer of an axial displacement of the actuation member to the meshing member and allow a rotation of the meshing member relative to the actuation member.

By arranging the bearing element between the actuation member and the meshing member, the axial displacement of the actuation member can be separated from the rotation of the meshing member. This results in an increased flexibility in terms of how to impart an axial displacement on the meshing member.

According to an embodiment of the invention, the bearing arrangement is a thrust bearing arrangement including a center washer and a first and second end washer, the thrust bearing accommodating rolling members between the first end washer and the center washer and between the second end washer and the center washer. A thrust bearing according to the above is suitable for accommodating axial loads.

According to a further embodiment of the invention, the meshing member is associated with the center washer and the actuation member is associated with the first and second end washers.

According to another embodiment of the invention, the actuation member is associated with at least one of the first and second end washers by a biasing member. The advantage of the biasing member is that axial play in the bearing arrangement is reduced.

According to a further embodiment of the invention, the actuation member includes a tubular member, having an inner surface and an outer surface.

According to another embodiment of the invention, at least a portion of the inner surface of the actuation member is provided with a spline. The actuation member may also be provided with an outward spline.

According to another embodiment of the invention, the assembly also includes a support member adapted to be attached to an internal combustion engine. The support member is tubular and provided with a spline meshing with the spline of the tubular member.

According to a further embodiment of the invention, the assembly includes a drive member with the outer peripheral surface provided with a spline meshing with the outward spline of the actuation member.

According to another embodiment of the invention, the assembly has a drive unit, adapted to rotate the drive member.

According to a further embodiment of the invention, the drive unit is an electric motor, e.g., a stepper motor.

According to another embodiment of the invention, the assembly includes a biasing element adapted to be located between actuation member and an internal combustion engine. The biasing element urges the actuation member and thus the meshing member in a predetermined position whenever no additional displacement is imparted on the actuation member, e.g. by a drive member.

According to a further embodiment of the invention, the biasing element is located between the actuation member and the support member. The biasing element may be a spring.

An aspect of the present invention relates to a method of varying the rotational phase between an outer wheel and an inner wheel of a spline VVT. The outer wheel and the inner wheel are adapted to rotate about an axis of rotation. The variation is obtained by imparting a displacement along the axis of rotation on a meshing member meshing with the outer wheel and the inner wheel. In particular, a corresponding displacement parallel to the axis of rotation is imparted on an actuation member and the displacement of the actuation member to the meshing member is transmitted through a bearing assembly to thereby allow a relative rotation between the meshing member and the actuation member.

The method may additionally impart the displacement on the actuation member by rotating a drive member meshing with the actuation member. Optionally, the axial displacement on the actuation member is imparted by rotating the drive member having a spline meshing with the outward spline of the actuation member with the rotation of the drive member with the rotation controlled by the drive unit.

The invention provides an advantage in providing a rotational phase difference between the camshaft and the crankshaft at substantially no power consumption. Furthermore, the change in rotational phase is accomplished rapidly and accurately.

The invention provides a packaging advantage in that the driving unit, adapted to drive an axial displacement on the center wheel of the spline VVT, may be placed outside of the spline VVT. The VVT, according to the present invention has a simple structure and can be cost effectively manufactured and assembled into an engine and vehicle system.

BRIEF DESCRIPTION OF THE DRAWINGS

The present invention will hereinafter be further explained by means of non-limiting examples with reference to the appended figures wherein.

DETAILED DESCRIPTION

The invention is described by exemplified embodiments. The embodiments are included to explain principles of the invention and not intended to limit the scope of the invention.

Figure 1:
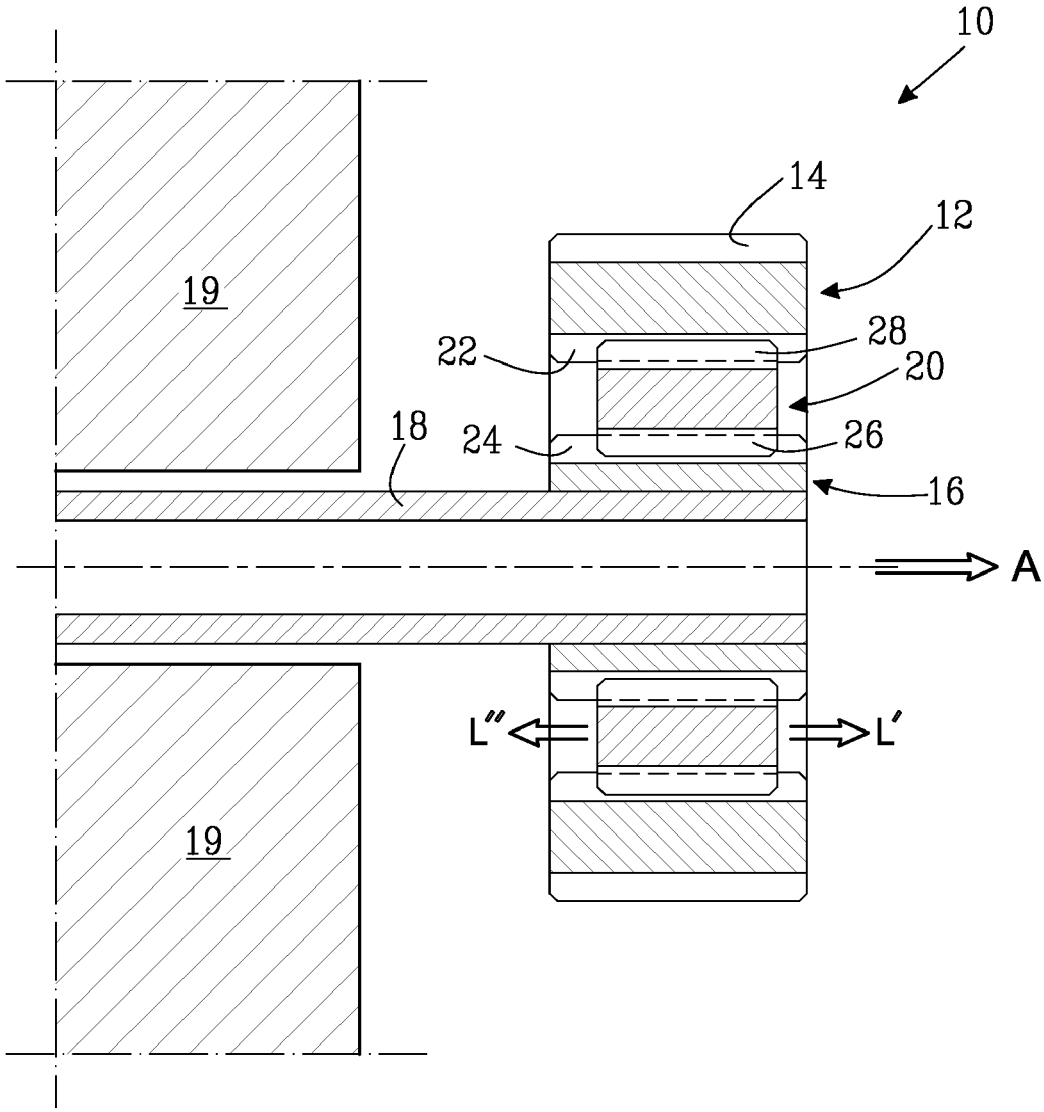
FIG. 1 is a cross-sectional view of a portion of a spline VVT.

FIG. 1 shows a cross-section of a spline VVT 10 of an internal combustion engine. The spline VVT 10 in FIG. 1 is known from the prior art and is constituted by an outer wheel 12 attached to a sprocket 14. In the variant of a spline VVT disclosed in FIG. 1, sprocket 14 is provided on the outside surface of outer wheel 12, but sprocket 14 may also be provided on a separate structural member (not shown) connected to outer wheel 12. Sprocket 14 is adapted to engage with a cam belt or cam chain (not shown) for transmitting rotation of a crankshaft (not shown) to the outer wheel 12. Optionally, the rotation of the crankshaft may be transmitted to sprocket 14 by a gear unit (not shown).

FIG. 1 further illustrates that the spline VVT 10 has an inner wheel 16 connected to a camshaft 18. Camshaft 18 generally extends from a portion 19 of a vehicle engine, which portion 19 may be a cylinder head although other portions of the engine may be suitable. In the variant of spline VVT illustrated in FIG. 1, inner wheel 16 is fixedly attached to the camshaft 18, e.g. by means of a friction joint; alternatively, inner wheel 16 may also be an integral part of camshaft 18 or engaged with camshaft 18 by an additional spline arrangement (not shown). For example, inner wheel 16 is keyed to camshaft 18. Furthermore, the spline VVT also includes a center wheel 20 meshing with both outer wheel 12 and inner wheel 16. Outer wheel 12 is inwardly provided with a spline 22 and inner wheel 16 is outwardly provided with a spline 24. Splines 22, 24 do not have the same pitch in the same groove direction. In the variant of a spline VVT 10 illustrated in FIG. 1, both splines 22, 24 are helical, preferably having the same pitch. Also, the groove direction of spline 24 of inner wheel 16 is opposite that of spline 22 of outer wheel 12. Center wheel 20 is provided with inward 26 and outward 28 splines, corresponding to the splines 24, 22 of inner 16 and outer 12 wheels.

When the engine is running, the crankshaft transmits a rotation to sprocket 14. Rotation of sprocket 14 is in turn transmitted to outer wheel 12, center wheel 20, inner wheel 16, and camshaft 18, so that the camshaft is rotating about an axis of rotation A. Transmission of the rotation of the crankshaft to the camshaft 18 has a certain gear ratio of 2:1, where the rotational speed of the camshaft is half the rotational speed of the crankshaft. When a change in the rotational phase between sprocket 14 and camshaft 18 is requested, center wheel 20 is displaced, i.e. along the axis of rotation A in a forward L' or backward L" direction. Due to the meshing of center wheel 20 with outer wheel 12 and inner wheel 16 and that splines 22, 24 of inner and outer wheels 12, 16 do not have the same pitch in the same groove direction, an axial displacement of center wheel 20 imparts a rotation to camshaft 18 in relation to sprocket 14. Thereby, the camshaft is phase shifted with respect to sprocket 14.

The pitch, i.e. the length of a complete helix turn along a helix axis, of splines 22, 24 in VVT 10 may, vary, depending on the application. For instance, splines 22, 24 of outer 12 and inner 16 wheels, respectively, of VVT 10 of FIG. 1 may have the same pitch, but in different directions. The magnitude of the pitch may be in the range of 100-400 mm/revolution. Splines 26, 28 of center wheel 22 generally have the same pitch as the splines of inner and outer wheels 12, 16. The magnitude of the pitch will govern the degree of rotation imparted on inner wheel 16 relative to outer wheel 12, when center wheel 20 is subjected to an axial displacement. Purely by way of example, if the pitch of splines 22, 24 is 300 mm/revolution and splines 22, 24 have opposite groove directions, inner wheel 16 rotates about 2.4° for every millimeter axial displacement of center wheel 20. Should the pitch be 120 mm/revolution, inner wheel 16 rotates approximately 6° for every millimeter axial displacement of center wheel 20.

As previously mentioned, the prior art teaches different ways of axially displacing center wheel 20, e.g. attaching a part of an electric motor (not shown) to center wheel 20 or applying a force on either of the end surfaces of the center wheel 20 by a hydraulic system (not shown).

Figure 2:
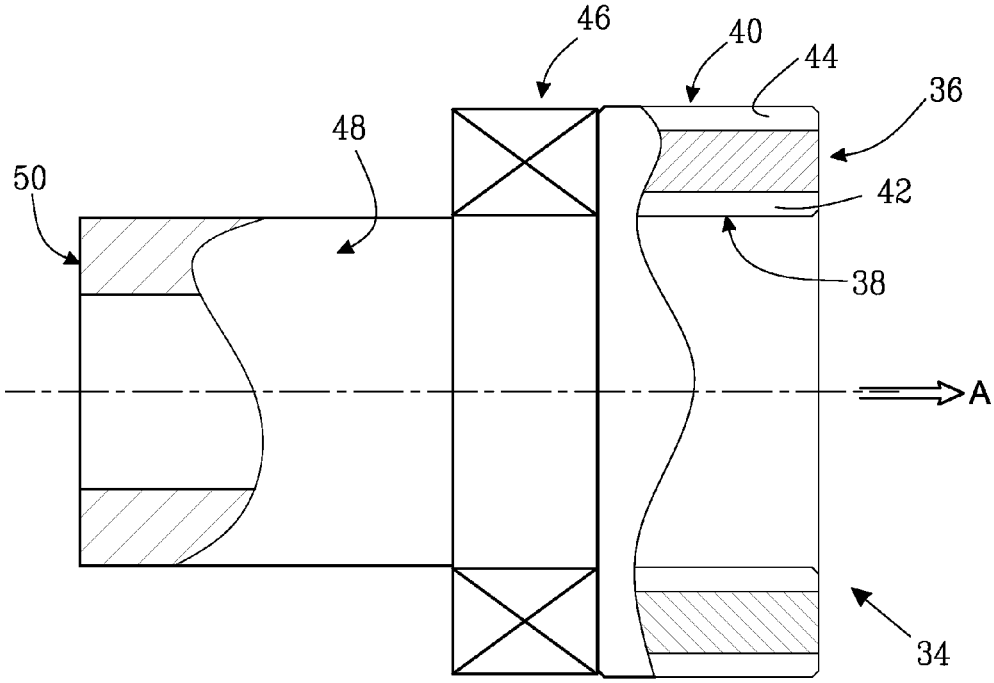
FIG. 2 is a partial cross-sectional view of an embodiment of a transmission assembly according to the present invention.

However, FIG. 2 illustrates a solution proposed by the present invention. FIG. 2 illustrates a transmission assembly 34, for imparting a phase difference between an outer wheel 12 and an inner wheel 16 of a spline VVT 10. As may be gleaned from FIG. 2, the assembly 34 has a tubular meshing member 36 having an inner surface 38 and an outer surface 40. At least a portion of the inner surface 38 is provided with a first spline 42 and at least a portion of the outer surface 40 is provided with a second spline 44. According to the invention, first spline 42 and second spline 44 do not have the same pitch in the same groove direction. In the embodiment illustrated in FIG. 2, both splines are helical and the groove directions of splines 42, 44 are opposite to one another. Furthermore, first and second helical splines 42, 44 in the embodiment illustrated in FIG. 2 extend throughout inner and outer surfaces 38, 40 respectively.

As further illustrated in FIG. 2, transmission assembly 34 further includes a bearing arrangement 46 and an actuation member 48. Bearing arrangement 46 is arranged between meshing member 36 and actuation member 48 so as to allow a transfer of an axial displacement of actuation member 48 to meshing member 36 and allow a rotation of meshing member 36 relative to actuation member 48.

In one embodiment, meshing member 36 is the center wheel in a spline VVT. Thus, an axial displacement, i.e. a displacement parallel to the axis of rotation A, of meshing member 36 is obtained by displacing actuation member 48 axially. Since bearing arrangement 46 is arranged between actuation member 48 and meshing member 36, actuation member 48 does not have to rotate with the components of the spline VVT assembly. Hence, an axial displacement may be imparted on actuation member 48, and consequently on meshing member 36, regardless of the rotation of the spline VVT. This allows axial displacement of actuation member 48 in a plurality of ways. For example, end surface 50 of actuation member 48 may be subjected to a positive or negative fluid pressure emanating from a hydraulic system (not shown) resulting in a force in the direction of the axis of rotation A. Optionally, as will be described below, the axial displacement of the actuation member may be imparted by a pinion arrangement (not shown in FIG. 2).

Figure 3:
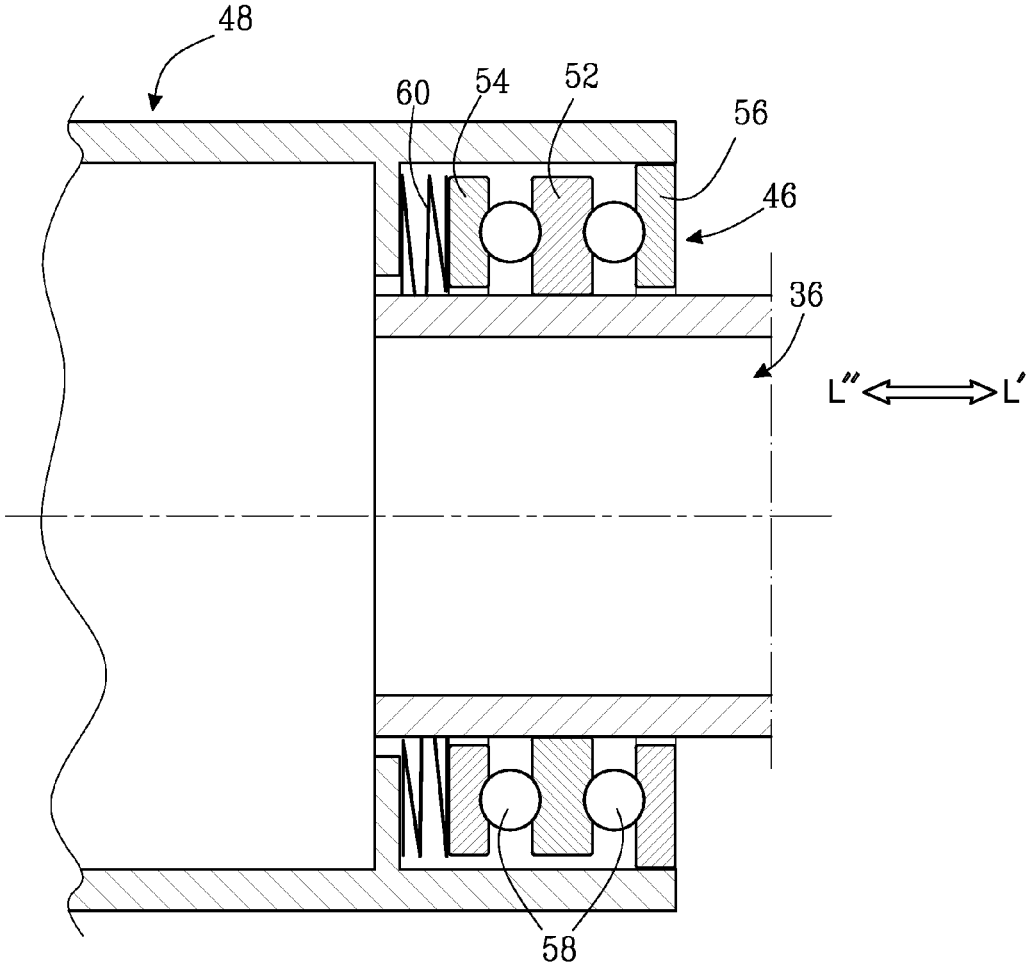
FIG. 3 is a cross-sectional view of a further embodiment of a transmission assembly according to the present invention.

Bearing arrangement 46 may be of one of a plurality of types. For example, the bearing arrangement may be a slide bearing (not shown). However, FIG. 3 illustrates a preferred embodiment of the present invention, in which the bearing arrangement 46 is a thrust bearing arrangement having a center washer 52 and a first and second end washer 54, 56. The thrust bearing accommodates rolling members 58 between the first end washer 54 and the center washer 52 and between the second end washer 56 and the center washer 52. The rolling members 58 in the embodiment illustrated in FIG. 3 are balls, but in other embodiments of transmission arrangement of the invention, cylindrical or tapered rollers may be applied.

In FIG. 3, meshing member 36 is preferably associated with center washer 52 and the meshing member 36 in FIG. 3 is connected to center washer 52 from the inside of bearing arrangement 46. Furthermore, in the FIG. 3 embodiment, actuation member 48 is associated with first and second end washers 54, 56. In FIG. 3, actuation member 48 is fixedly attached to second end washer 56, whereas actuation member 48 is connected to first end washer 54 by a biasing member 60, which in the embodiment disclosed in FIG. 3 is a helical spring although other types of biasing members may be feasible, such as cup springs (not shown). Alternatively, actuation member 48 is fixedly attached to first end washer 54.

The purpose of biasing member 60 is to reduce possible play in bearing assembly 46. Particularly, when the direction of the axial displacement of actuation member 48 is altered, e.g. when the direction of the displacement of actuation member 48 is changed from a forward L' to a backward L" direction, there is a risk of an initial play in bearing assembly 46, resulting in an axial displacement different from the one desired. This initial play is reduced and even removed by inserting biasing member 60, which always forces actuation member 48 in a direction away from meshing member 36. The force imparted by biasing member 60 is preferably larger than the force to impart an axial displacement on actuation member 48.

Figure 4:
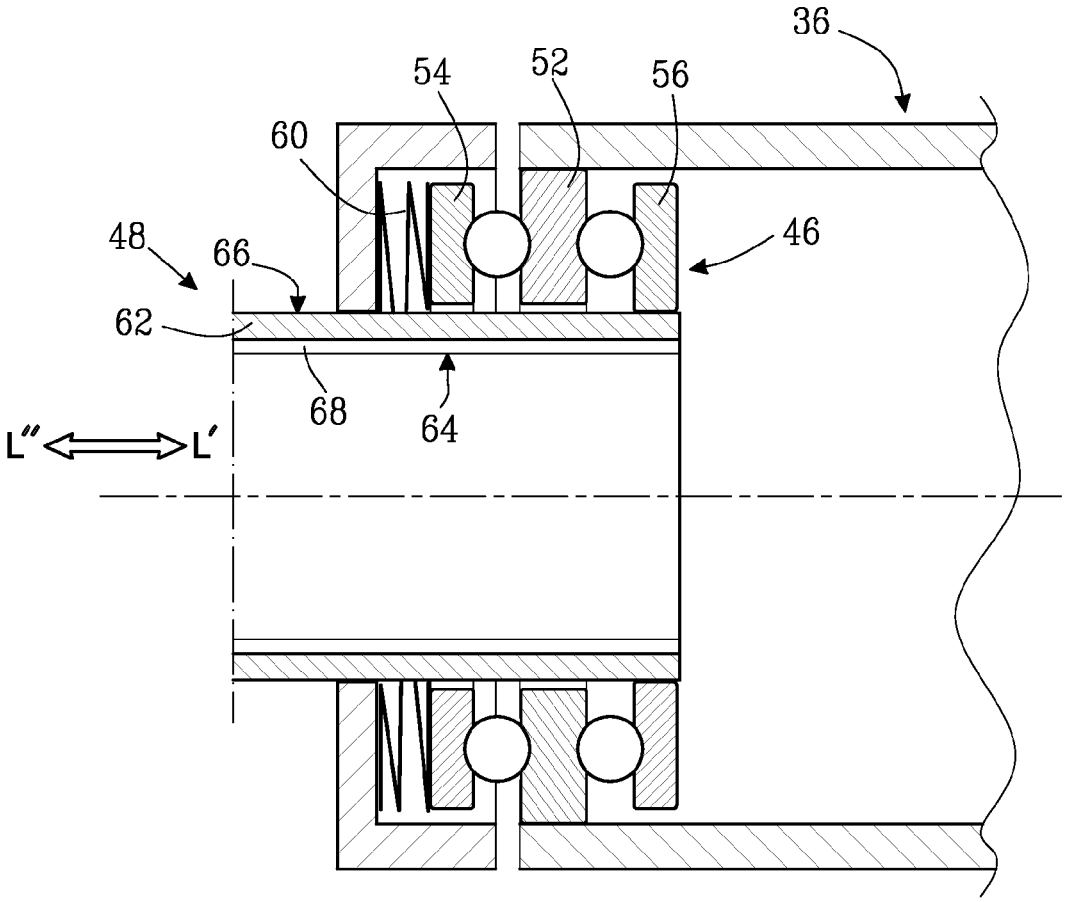
FIG. 4 is a cross-sectional view of another embodiment of a transmission assembly according to the present invention.

FIG. 4 illustrates an embodiment of transmission assembly 34 which is similar to the assembly illustrated in FIG. 3 but where meshing member 36 is connected to center washer 52 from the outside of bearing arrangement 46 and actuation member 48 is connected to first and second end washers 54, 56 from the inside of bearing arrangement 46. In some embodiments of transmission assembly 34, meshing member 36 may be associated with first and second end washers 54, 56 and actuation member 48 may be associated with center washer 52.

Actuation member 48 has a tubular member 62, having an inner surface 64 and an outer surface 66, as illustrated in FIG. 4. In one embodiment, at least a portion of inner surface 64 of actuation member 48 is provided with a helical spline 68.

Figure 5:
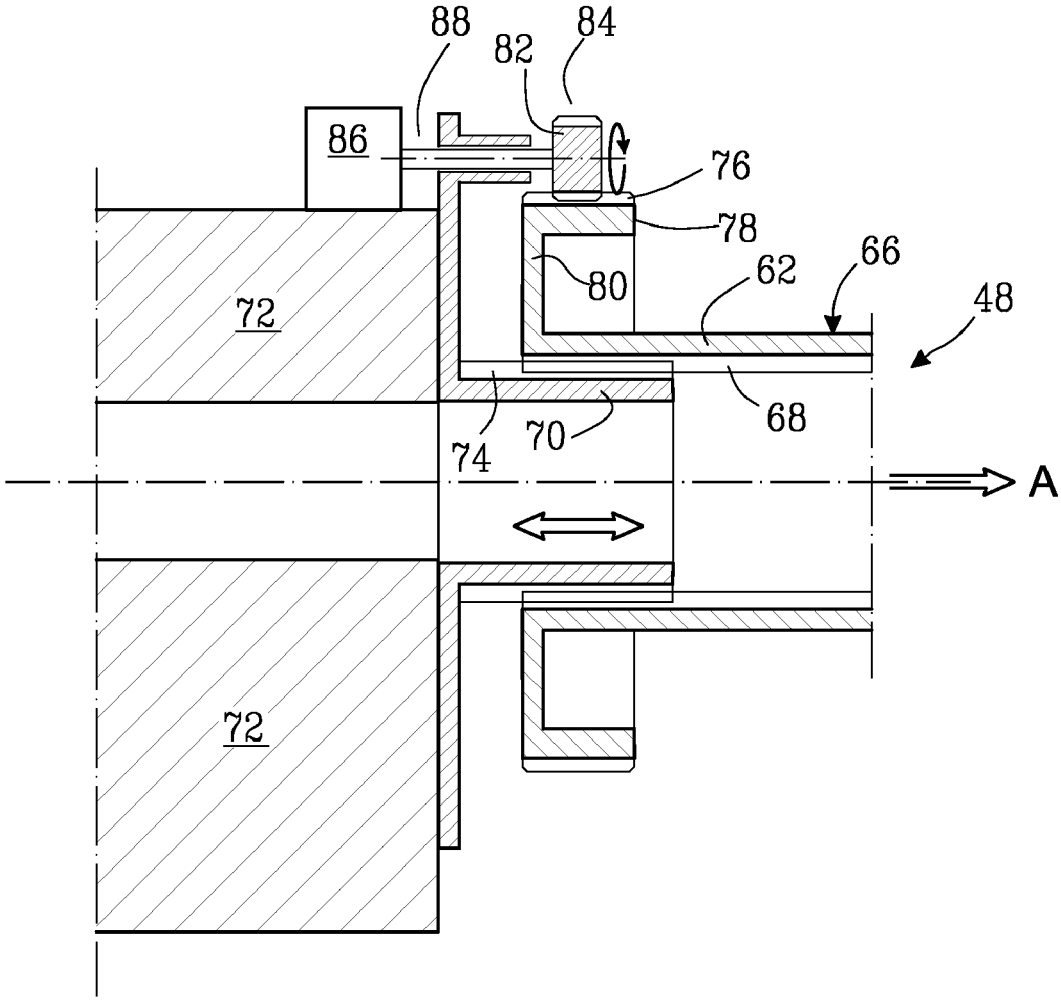
FIG. 5 is a cross-sectional view of a part of a further embodiment of a transmission assembly according to the present invention.

Actuation member 48 includes a tubular member 62 provided with a spline 68 which may be used in an embodiment of the transmission assembly of the invention an example of which is illustrated in FIG. 5, in which assembly 34 further includes a support member 70 attached to an internal combustion engine. In the embodiment illustrated in FIG. 5, support member 70 is attached to the cylinder head 72 of the engine. In FIG. 5, support member 70 is tubular and provided with a spline 74 meshing with spline 68 of tubular member 62. Splines 68 and 74 are helical splines. Alternatively, in some embodiments of the transmission assembly, straight splines are used.

As further illustrated in FIG. 5, actuation member 48 is provided with an outward spline 76, preferably a straight spline. In the embodiment illustrated in FIG. 5, outward spline 76 is provided on the outer surface of an auxiliary tubular member 78 of the actuation member 48, which auxiliary tubular member 78 is attached to the tubular member 62 by a an intermediate member 80, which intermediate member 80 preferably is in the shape of a washer. In one embodiment, auxiliary tubular member 78, intermediate member 80 and tubular member 62 are attached to one another by conventional attachment methods, such as gluing or welding. Alternatively, members 78, 80, 62 are made in one piece. Optionally, auxiliary tubular member 78 and intermediate member 80 are omitted and outward spline 76 is instead provided on outer surface 66 of tubular member 62 of actuation member 48.

Referring to FIG. 5, the illustrated embodiment of the transmission assembly 34 includes a drive member 82 in which the outer peripheral surface is provided with a spline 84 meshing with outward spline 76 of actuation member 48. In the embodiment illustrated in FIG. 5, drive member 82 is substantially cylindrical and spline 84 is a straight spline. Accordingly, outward spline 76 of actuation member 48 is a straight spline. FIG. 5 further illustrates that the assembly has a drive unit 86, adapted to rotate drive member 82. In the embodiment illustrated in FIG. 5, drive unit 86 is an electric motor, in this case a stepper motor, which is connected to drive member 84 by a shaft 88. When drive unit 86 is operated, drive member 82 rotates. Since spline 84 of drive member 82 is meshing with outward spline 76 of actuation member 48, actuation member 48 is rotated. Due to helical splines 74, 68 of support member 70 and tubular member 62, respectively, as a result of the rotation, actuation member 48 is displaced axially, i.e. a displacement along the axis of rotation A of actuation member 48. Preferably, drive unit 86 is in communication with an electronic control unit (not shown), adapted to control drive unit 86.

Since the meshing member is connected to actuation member 48 by a bearing arrangement (not shown in FIG. 5), axial displacement of the actuation member is transferred to the meshing member. If the meshing member is the center wheel of a spline VVT, the rotational phase of the camshaft is altered by the axial displacement of the meshing member.

Figure 6:
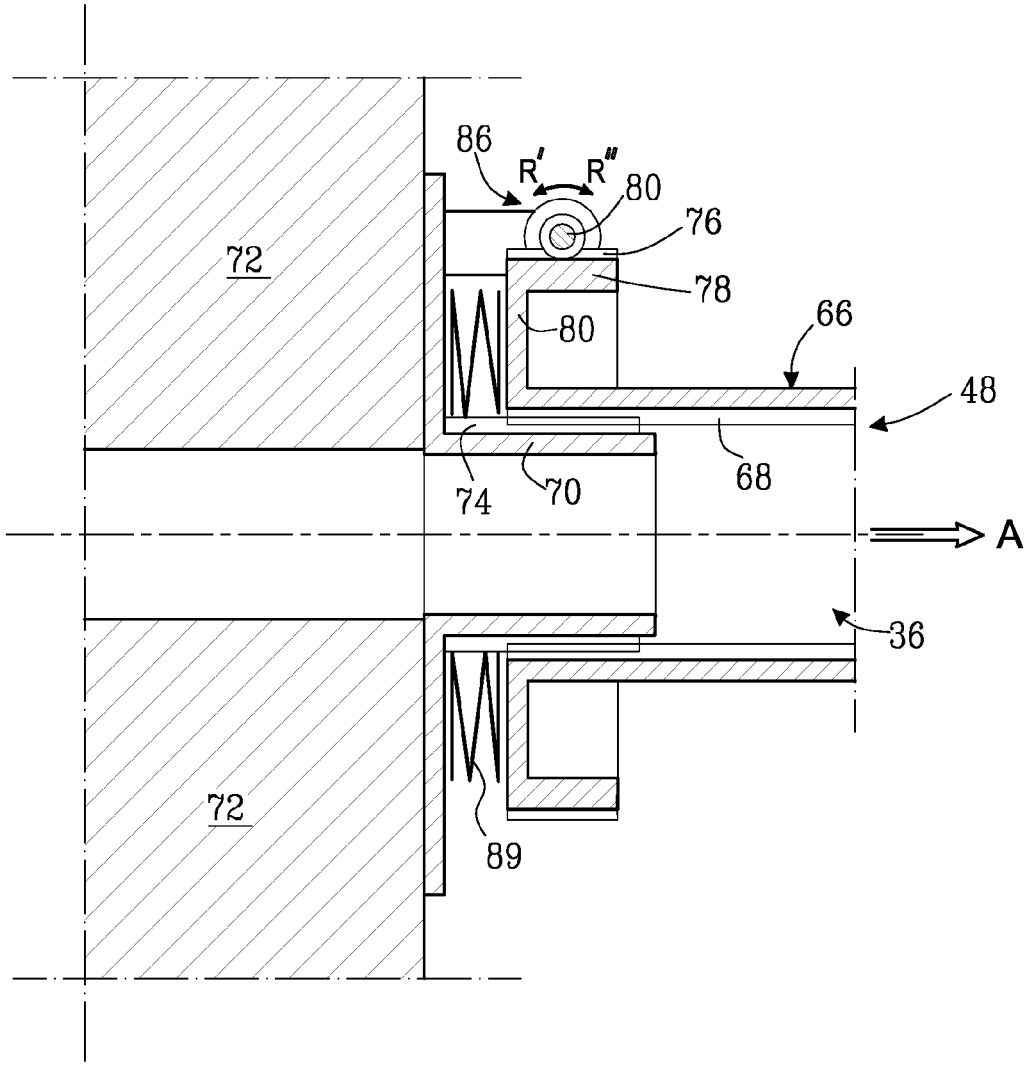
FIG. 6 is a cross-sectional view of a part of another embodiment of a transmission assembly according to the present invention.

FIG. 6 illustrates an alternative to the embodiment of the transmission assembly illustrated in FIG. 5, in which outward spline 76 of actuation member 48 is a helical spline and drive member 82 is a screw adapted to rotate about an axis of rotation which is substantially perpendicular to the plane of the cross section illustrated in FIG. 6. Thus, when a drive unit 86 rotates drive member 82 in either of the rotational directions R' or R", actuation member 48 moves along the axis of rotation A.

FIG. 6 also illustrates one embodiment of the connection between actuation member 48 and the engine, in which the transmission assembly has a biasing member 89, located between actuation member 48 and the engine. According to one embodiment shown in FIG. 6, biasing member 89 is a helical spring and located between actuation member 48 and support member 70. Thus, if drive unit 82 of FIG. 6 is disengaged from outward spline 76 of actuation member 48, biasing member 89 forces actuation member 48 to a predetermined axial position, thus forcing meshing member 36 to a predetermined axial position in the spline VVT. This results in a corresponding predetermined rotational phase difference between the sprocket and the inner wheel. In embodiments of transmission assembly 34 of the present invention in which actuation member 48 and support member 70 are meshing by helical splines, biasing member 89 may be adapted to impart a rotation on actuation member 48, i.e. biasing member 89 may be a torsion spring (not shown).

Figure 7:
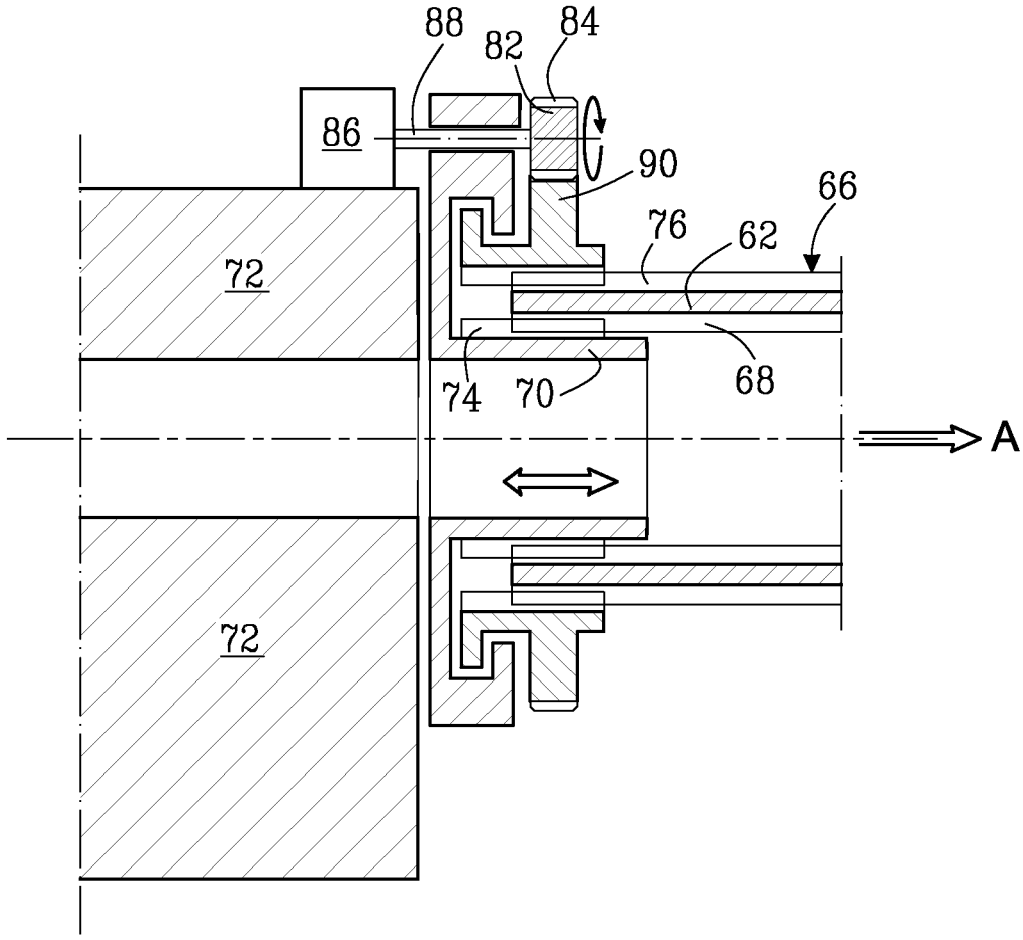
FIG. 7 is a cross-sectional view of a part of a further embodiment of a transmission assembly according to the present invention.

FIG. 7 illustrates a further embodiment of transmission assembly 34 of the present invention. Compared to the FIG. 5 embodiment, auxiliary tubular member 78 and intermediate member 80 of actuation member 48 are omitted. Instead, outward spline 76 is provided on outer surface 66 of tubular member 62 and assembly 34 includes a mediating member 90 meshing with both spline 84 of drive member 82 and outward spline 76 of actuation member 48. In FIG. 7, elements 72 and 70 are shown spaced apart. However, in other embodiments, elements 72 and 70 are coupled together.

Figure 8:
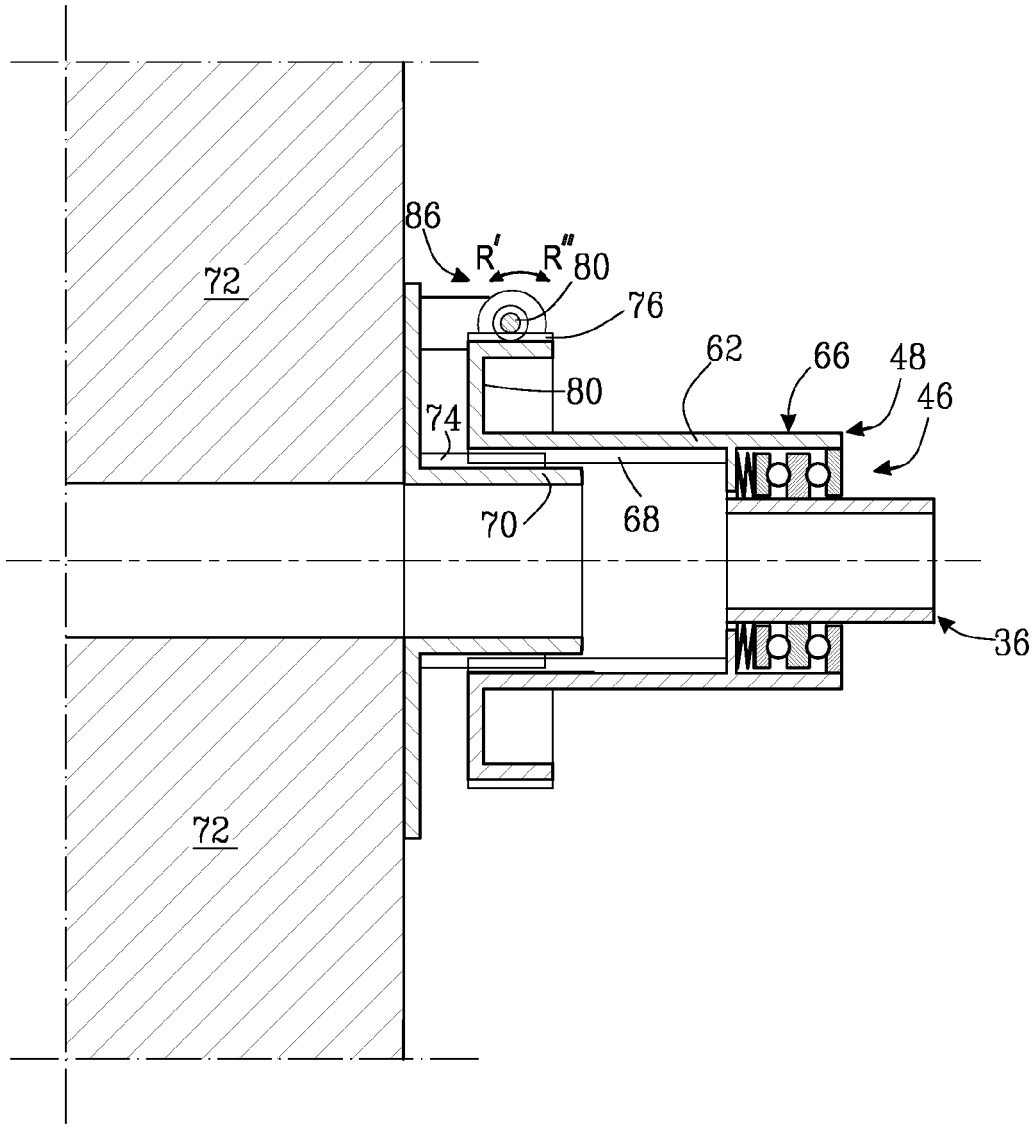
FIG. 8 is a cross-sectional view of an embodiment of a transmission assembly according to the present invention.

Finally, FIG. 8 illustrates the FIG. 6 embodiment of the transmission assembly including bearing arrangement 46 and meshing member 36.

Further modifications of the invention within the scope are feasible. For instance, drive member 82 and actuation member 48 may form a worm gear. Furthermore, actuation member 48 may in some embodiments of the present invention be adapted to be located outside of the spline VVT, i.e. the side of the spline VVT not facing the engine. As such, the present invention should not be considered as limited by the embodiments and figures described herein. Rather, the full scope of the invention should be determined by the appended claims, with reference to the description and drawings.

We claim:

1. A transmission assembly (34), for imparting a phase difference between an outer wheel (12) and an inner wheel (16) of a splined VVT (10), comprising:

a tubular meshing member (36) having an inner surface (38) and an outer surface (40) with at least a portion of said inner surface (38) being provided with a first helical spline of said splined VVT (42) and at least a portion of said outer surface (40) being provided with a second helical spline of said splined VVT (44), said first and said second splines (42, 44) having different pitches;

an actuation member (48) proximate said tubular meshing member (36); a bearing arrangement (46) arranged between said meshing member (36) and said actuation member (48), said bearing arrangement (46) being a thrust bearing arrangement comprising a center washer (52), a first end washer (54) and a second end washer (56), said thrust bearing accommodating rolling members (58) between said first end washer (54) and said center washer (52) and between said second end washer (56) and said center washer (52), said actuation member (48) is associated with at least one of said first and second end washers (54, 56) by a biasing member (60).

2. The transmission assembly (34) according to claim 1, wherein both the first and second splines (42, 44) are helical, said first and second splines (42, 44) having opposite groove directions.

3. The transmission assembly (34) according to claim 1, wherein said meshing member (36) is associated with said center washer (52) and said actuation member (48) is associated with said first and second end washers (54, 56).

4. The transmission assembly (34) according to claim 1, wherein said actuation member (48) comprises a tubular member (62), having an inner surface (64) and an outer surface (66).

5. The transmission assembly (34) according to claim 4, wherein at least a portion of said inner surface (64) of said tubular member (62) is provided with a spline (68).

6. The transmission assembly (34) according to claim 5, wherein said spline (68) of said inner surface (64) of said tubular member (62) is a helical spline.

7. The transmission assembly (34) according to claim 4, wherein said actuation member (48) is provided with an outward spline (76).

8. The transmission assembly (34) according to claim 7, wherein said outward spline (76) is a straight spline.

9. The transmission assembly (34) according to claim 5, further comprising: a support member (70) adapted to be attached to an internal combustion engine, said support member (70) being tubular and provided with a spline (74) meshing with said spline (68) of said tubular member (62).

10. The transmission assembly (34) according to claim 9, further comprising: a drive member (82) which outer peripheral surface is provided with a spline (84) meshing with said outward spline (76) of said actuation member (48).

11. The transmission assembly (34) according to claim 10, further comprising: a drive unit (86) adapted to rotate said drive member (82).

12. The transmission assembly (34) according to claim 11, wherein drive unit (86) is an electric motor, preferably a stepper motor.

13. The transmission assembly (34) according to claim 1, further comprising: a spring (89) adapted to be located between said actuation member (48) and an internal combustion engine.

14. The transmission assembly (34) according to claim 11, further comprising: a spring (89) adapted to be located between said actuation member (48) and an internal combustion engine wherein said spring (89) is located between said actuation member (48) and said support member (70).

* * * * *